US005156097A

United States Patent [19]

Booth et al.

[11] Patent Number: 5,156,097

[45] Date of Patent: Oct. 20, 1992

[54] COMBUSTION APPARATUS

[76] Inventors: Gerry Booth, Crab Lane, Blackley, Manchester M9 3NB; Stewart Donnelly, 9 Benmoor Road, Blackley, Manchester M9 2IG; Brian Lindley, 7 Easby Road, Hollins Estate, Hollins, Manchester M24 3FT, all of Great Britain

[21] Appl. No.: 689,784

[22] PCT Filed: Nov. 16, 1989

[86] PCT No.: PCT/GB89/01357

§ 371 Date: Jun. 13, 1991

§ 102(e) Date: Jun. 13, 1991

[87] PCT Pub. No.: WO90/05875

PCT Pub. Date: May 31, 1990

[30] Foreign Application Priority Data

Nov. 17, 1988 [GB] United Kingdom ..... 8826909

[51] Int. Cl.[5] ..... F23B 5/00

[52] U.S. Cl. ..... 110/214; 110/204; 110/205; 431/5

[58] Field of Search ..... 110/204, 205, 212, 214; 431/5; 422/168, 182

[56] References Cited

U.S. PATENT DOCUMENTS

| | | | |
|---|---|---|---|
| 3,670,667 | 6/1972 | Faurholdt | 110/214 X |
| 4,635,568 | 1/1987 | Angelo, II | 110/214 |
| 4,674,417 | 6/1987 | Hoskinson | 110/214 |
| 4,883,003 | 11/1989 | Hoskinson | 110/212 |

*Primary Examiner*—Edward G. Favors
*Attorney, Agent, or Firm*—Woodard, Emhardt, Naughton, Moriarty & McNett

[57] ABSTRACT

Combustion apparatus comprises a combustion chamber for effecting primary combustion of combustible material charged thereinto, an exhaust conduit for exhaust gases emitted by the primary combustion, primary air inlet means for directing primary air into said combustion chamber, and secondary air inlet means for directing secondary air into the exhaust conduit at least in the region adjacent the combustion chamber so as to promote further combustion of said exhaust gases, said secondary air inlet means including an air distributor arranged centrally of the conduit characterized in that secondary air inlets are additional provided in the wall of the conduit over at least part of the extent of the air distributor.

14 Claims, 2 Drawing Sheets

18
33
24
25a
26a
30
31
21
26a
26
3
24
25a
25
27b
23
27a
2
22
17
1c
19
20
1b
1
11
14
12
15
4
13
16
28
4a
4b
8
9
5
10
7a
1a
7
6
35
32
34

COMBUSTION APPARATUS

This invention relates to combustion apparatus, for example a furnace or incinerator, for burning waste material, particularly but not exclusively for the incineration of rubber tires and like waste material.

The disposal of scrap tires has long been a problem. Tipping and subsequent burial may cause underground fires. Incineration, with the prospect of energy recovery, is an attractive proposition but has proved difficult to achieve at acceptable pollution levels.

It is well known to provide combustion apparatus with a primary combustion chamber into which the combustible material is charged and secondary and possibly further combustion chambers to which exhaust gases from the preceding combustion chamber are directed for further combustion in supplementary air supplied to these zones or chambers. For example U.S. Pat. No. 4,674,417 to Hoskinson proposes an improved stack construction for an incinerator capable of overcoming the "candlestick" effect in which air introduced into the stack for secondary combustion purposes merely flows along the inner wall of the stack without adequately mixing with the waste gases flowing along the central core. In order to overcome this problem air is introduced into the stack through an elongated vertical tube mounted centrally of the stack and having formed along its length a plurality of ports that face outwardly at an angle so that air introduced into the tube will be directed downwardly and radially outward towards the inner wall of the stack. Depending upon the relative dimensions of the central tube and the stack there may nevertheless continue to be problems with waste gases flowing upwardly over the inner wall of the stack, i.e. the turbulence generated by the central tube may not penetrate to the inner wall of the stack.

The present invention is intended to obviate or mitigate the aforesaid disadvantage by providing an improved design of incinerator capable of essentially complete combustion of waste material.

According to the present invention there is provided combustion apparatus comprising a combustion chamber for effecting primary combustion of combustible material charged thereinto, an exhaust conduit for exhaust gases emitted by the primary combustion, primary air inlet means for directing primary air into said combustion chamber, and secondary air inlet means for directing secondary air into the exhaust conduit at least in a region adjacent the combustion chamber so as to promote further combustion of said exhaust gases, said secondary air inlet means including air distributor means arranged in the conduit, characterised in that secondary air inlets are additionally provided in the wall of the conduit over at least part of the extent of the air distributor means.

The invention will now be further described by way of example only, with reference to the accompanying drawings, in which.

Figure 1:
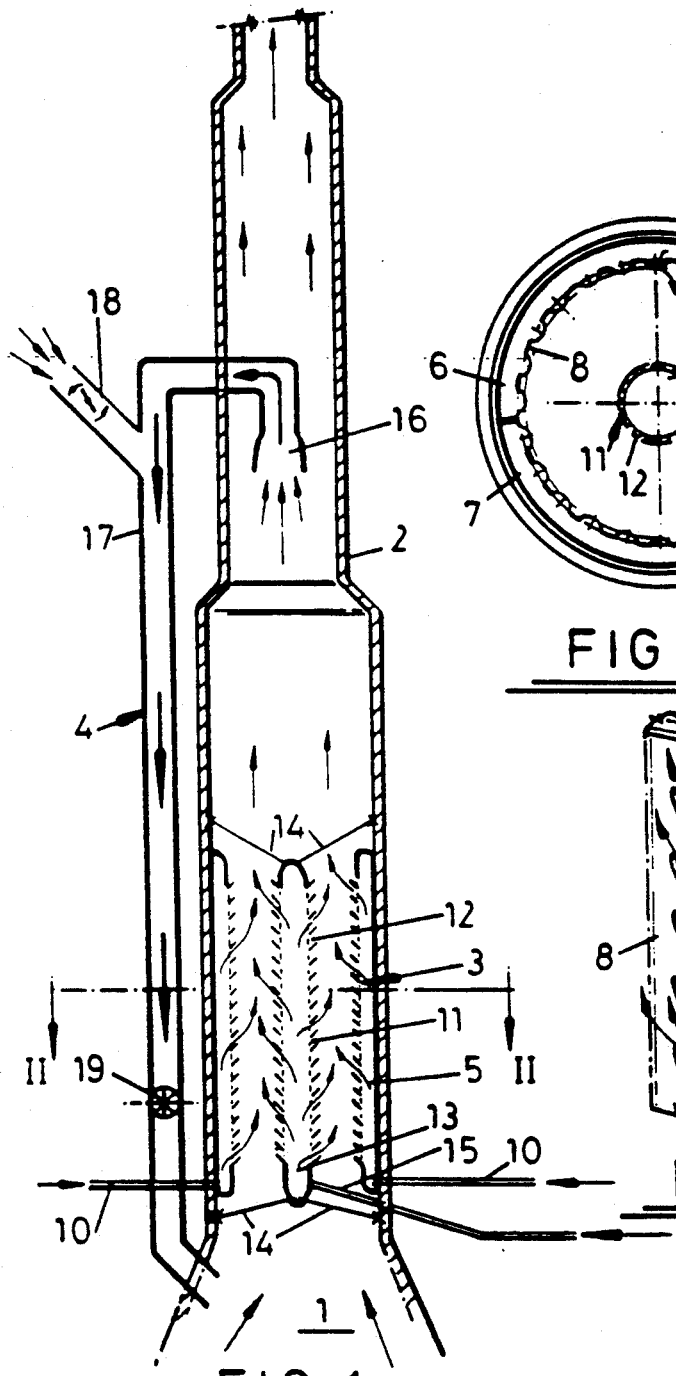
FIG. 1 is a diagrammatic part-sectional view of an existing furnace fitted with secondary air inlet means and exhaust gas recycling means.
Figure 2:
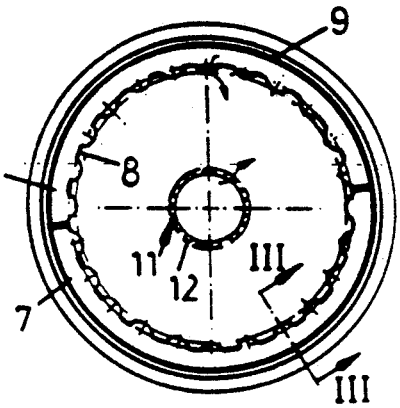
FIG. 2 is a cross-section on line II—II of FIG. 1.
Figure 3:
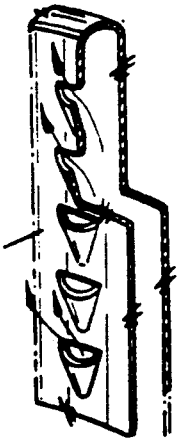
FIG. 3 is a section on line III—III of FIG. 2.

Referring now to FIGS. 1 to 3 of the drawings, an existing furnace before modification comprises a combustion chamber 101 and an exhaust conduit in the form of a stack 102. In order to reduce or eliminate noxious exhaust omissions, the furnace is fitted with secondary air inlet means 103 and exhaust gas recycling means 104. The secondary air inlet means 103 comprises a hollow cylindrical sleeve 105 made in two parts 106, 107 (FIG. 2) for ease of assembly and dimensioned to fit closely in the lower part of the stack 102. The sleeve 105 has inner and outer walls 108, 109 defining therebetween an annular plenum chamber connected by a pipe 110 to a source of compressed air (not shown). The inner wall 108 of the sleeve 105 has upwardly directed air inlet openings, the form of which is shown in detail in FIG. 3. The secondary air inlet means 103 further comprises a central distributor 111 for secondary combustion air which takes the form of an elongated, streamlined housing 112 for a plenum chamber 113 suspended on the centre line of the stack 102 by supports 114 and connected to the source of compressed air by the pipe 115. The housing 112 is provided with vertical rows of air inlet openings similar to those of the sleeve 105. It will be noted that the air inlets in the inner wall 108 of the sleeve 105 are provided over the full extent of the central distributor 111 so that the ascending column of exhaust gases in this region is provided with secondary air from the inner and outer peripheries of its annular section.

The exhaust recycling means 104 comprises an exhaust gas collector in the form of an inverted cup 116 positioned in the stack 102 well above the secondary air inlet means 103. The collector 116 is connected to a conduit 117 with a valve controlled air inlet 118. The conduit 117 is connected to the primary combustion chamber 101. A fan 119 assists the return flow of the exhaust gases in the conduit 117.

In use, with combustion proceeding in the primary combustion chamber 101, air is supplied to the secondary air inlet means 103 at a pressure which is just sufficient to permit the rising exhaust gases to draw sufficient secondary combustion air from the sleeve 105 and the housing 112. This action is assisted by the passing of the gases at speed over the shaped openings, i.e. a Venturi effect. Secondary combustion or afterburning of the exhaust gases in this region of the stack 102 is thus encouraged. Thorough mixing of the secondary combustion air with the exhaust gases is ensured by provision of air inlets on both outside and inside peripheries of the annular cross-section flow passage.

A proportion of the exhaust gases downstream of the secondary air inlet means 103 is collected by the collector 116 and returned via the conduit 117 to the primary combustion chamber 101 with admission of further combustion air through the valve controlled inlet 118. The exhaust gas recycling means 104 is not an essential feature of the invention and may be omitted or kept out of operation if the secondary air inlet means is providing satisfactory afterburning.

Figures 4, 5:
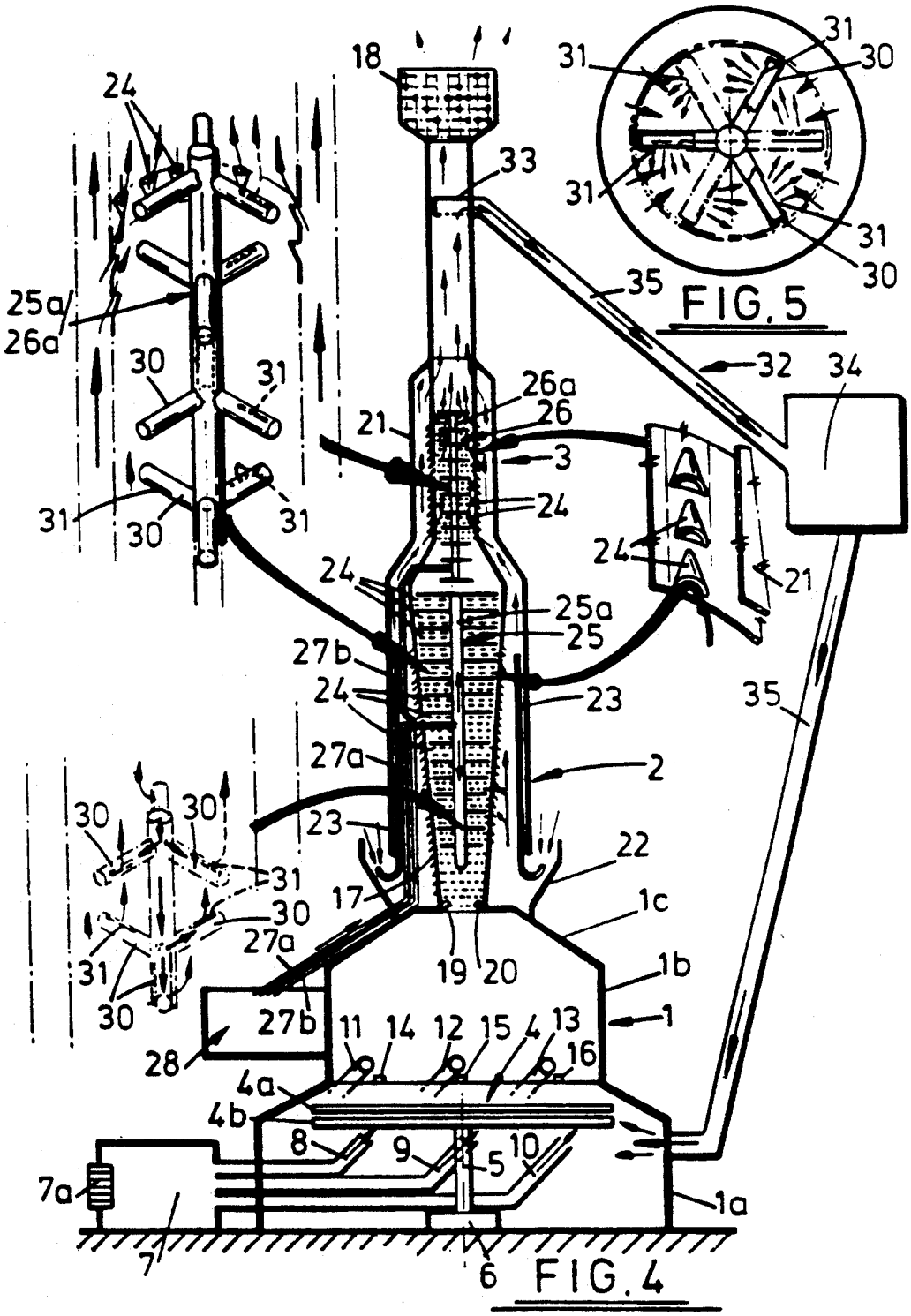
FIG. 4 is a diagrammatic vertical section of a second embodiment of combustion apparatus in accordance with the invention, with insets showing portions thereof to an enlarged scale.
FIG. 5 is a section of the stack to an enlarged scale showing the arrangement of the air distributing pipes.

Referring now to FIGS. 4 and 5 of the drawings, a second embodiment of furnace in accordance with the invention comprises a primary combustion chamber 1 surmounted by a stack divided into a lower or secondary combustion zone 2 and an upper or tertiary combustion zone 3. Waste tires or other material to be burned is supplied to the primary combustion chamber 1 and supported on a turntable 4 mounted on a drive shaft 5 connected to a transmission indicated diagrammatically at 6. The turntable 4 comprises an upper grate 4a and a solid base 4b. Air is supplied to the primary combustion chamber at atmospheric pressure from a chamber 7 controlled by an inlet valve 7a and two series of ducts 8, 9 and 10 (below the turntable 4) and 11, 12 and 13 (above the turntable 4). The open ends of the ducts 8–13 are angled in order to create a swirling effect within the primary combustion chamber 1. Propane fuelled pilot burners 14, 15 and 16 are mounted in the primary combustion chamber above the turntable 4. The primary combustion chamber 1 is of circular section with an enlarged base 1a, a cylindrical intermediate section 1b and an upwardly tapering section 1c connecting with a downwardly tapering section of the stack 17 defining the secondary combustion chamber 2 the enlarged upper end of which connects with the upwardly tapering lower end of the tertiary combustion zone 3 which is then generally cylindrical as is the upper part of the stack 17 which is capped by a conventional windbreaker 18. Further propane fuelled pilot burners 19, 20 are provided at the junction of the primary and secondary combustion chambers 1, 2. Those portions of the stack 17 constituting the secondary and tertiary combustion zones 2, 3 are shrouded in a casing 21 with an open lower end engaging in a funnel 22 for encouraging natural air draft into and up the casing as indicated by the arrows. Penetration of air to the upper regions of the casing 21 is encouraged by four pipes 23 arranged equi-angularly around the lower end of the stacks 17 (only two being shown in the plane of the drawing) having outwardly curved lower ends with inlets positioned in the incoming air draft and extending lengthwise to near the upper end of the secondary combustion zone 2 so as to deliver additional air into this region and the tertiary combustion zone thereabove. The outer wall of the stack 17 in the secondary and tertiary combustion zones is provided with downwardly directed air inlet openings 24 shown to an enlarged scale in the inset of FIG. 4. The secondary and tertiary combustion zones 2, 3 are equipped with respective air distributors 25, 26 supplied with air by respective independently regulatable supply pipes 27a, 27b connected to a source of compressed air 28. It will be noted that the air inlet openings 24 are provided over the major part of the vertical extent of the respective distributors 25, 26 so that the ascending column of gases is fully mixed with secondary air as described below.

Each distributor 25, 26 comprises an air feed pipe 25a, 26a supported axially and centrally in the stack 17 by means not shown and connected to the respective air supply 27a, 27b. As illustrated in greater detail in the insets of FIG. 4, the central pipe 25a, 26a of each distributor 25, 26 has horizontal branches (indicated diagrammatically by horizontal lines in FIG. 4) at a plurality of vertically spaced junctions. Each junction along the distributor pipe 25a, 26a connects with three equiangularly spaced branch pipes 30 with the branch pipes of the next adjacent junction being turned through 60° as illustrated in FIG. 5 in plan view. Save at the lower end of the secondary combustion zone distributor 25 the branch pipes 30 are provided on corresponding sides thereof with lateral air outlet slots 31 whose centre lines (and the axes of the pipes) lie on a common horizontal plane for each junction so that a sheet of air is directed from the same side of each branch pipe 30 in the direction towards the adjacent branch pipe of the same junction as indicated by the arrows in FIG. 5. This generally horizontally emitted air mingles with the inwardly directed air entering through the inlets 24 in the wall of the stack 17 as a result of a Venturi effect so as to create (as seen from the top of the FIG. 5) a counterclockwise helical ascending airstream in each of the secondary and tertiary combustion zones thereby effectively lengthening these zones and providing more time for full combustion as well as ensuring complete mixing of secondary air with theflue gases. At the lower end of the secondary combustion zone 2 the branch pipes 30 from the first one or several junctions of the distributor pipe 25a have their outlet slots 31 provided on the upper side of the branch pipes so that air emanating from the distributor 25 in this region is directed upwardly away from the primary combustion chamber 1 (see lower inset to FIG. 4). The branch pipes at higher junctions may have their outlet slots 31 positioned intermediate the vertical and lateral orientations described above in order to ensure a smooth transition from vertical flow of secondary air from the lowermost branch pipes 30 to generally horizontal air emission from the higher branch pipes 30.

The furnace is provided with exhaust recycling means 32 comprising an exhaust gas collector in the form of a downwardly open pipe 33 positioned in the stack above the tertiary combustion zone and connected by an adjustable recirculating cyclone fan 34 and piperwork 35 to the base 1a of the primary combustion chamber 1.

The operation is similar to that of the first embodiment save that the potential for full combustion is enhanced because the air distributors in the secondary and tertiary combustion zones ensure penetration and mixing of secondary air throughout the column of ascending flue gases.

It will be appreciated that numerous modifications and variations may be made without departing from the scope of the invention. For example, in the second embodiment of FIGS. 4 and 5 the tertiary combustion zone may be omitted or further combustion zones may be provided. Entry of air into the casing 21 and thence into the stack via the openings 24 may be further encouraged by supplying compressed air to the casing. The casing may be omitted while still achieving satisfactory air input to the stack 17. Adequate secondary combustion may also be achieved without the exhaust recycling means 32.

Since very high combustion temperatures are achieved particularly in the secondary and further combustion zones of the stack it will be appreciated that the furnace is preferably constructed of high temperature resistant materials e.g. stainless steel or ceramic material to the extent necessary to ensure adequate working life under these extreme conditions.

The secondary air inlet means may be incorporated in the construction of the combustion apparatus or alternatively fitted as a modification to existing apparatus, as described in the case of the first embodiment with reference to FIGS. 1 to 3. The secondary air distributor means arranged in the conduit may be differently constructed, e.g. transverse pipes with outlet slots may extend across the conduit and be supplied with air from outside the conduit; alternatively, a helically formed secondary air pipe may be disposed in the conduit with outlet slots at suitable intervals along its helical extent.

We claim:

1. A combustion apparatus comprising:

a combustion chamber for effecting primary combustion of combustible material charged thereinto;

an exhaust conduit for exhaust gases emitted by the primary combustion;

primary air inlet means for directing primary air into said combustion chamber; and secondary air inlet means for directing secondary air into said exhaust conduit at least in a region adjacent said combustion chamber so as to promote further combustion of the exhaust gases, said secondary air inlet means including air distributor means arranged in said exhaust conduit, said exhaust conduit including a wall defining secondary air inlets over at least part of the extent of the air distributor means, the secondary air inlets having upwardly directed internal openings through which air is drawn by the ascending column of exhaust gas.

2. The combustion apparatus of claim 1 wherein the air distributor means comprises a pipe having upwardly directed peripheral air outlet openings arranged along its length.

3. The combustion apparatus of claim 1 wherein the air distributor means is connected to a source of compressed air.

4. The combustion apparatus of claim 3 wherein the air distributor means comprises a pipe having upwardly directed peripheral air outlet openings arranged along its length.

5. The combustion apparatus of claim 1 and which further includes a casing enshrouding said exhaust conduit in the region of the secondary combustion zone, said casing having a lower opening through which air is introduced to flow upwardly over the outside surface of said exhaust conduit.

6. The combustion apparatus of claim 1 and further including exhaust gas recycling means comprising a return pipe for returning part of the gas flow downstream of said secondary air inlet means to said primary combustion chamber.

7. A combustion apparatus comprising:

a combustion chamber for effecting primary combustion of combustible material charged thereinto;

an exhaust conduit for exhaust gases emitted by the primary combustion;

primary air inlet means for directing primary air into said combustion chamber; and secondary air inlet means for directing secondary air into said exhaust conduit at least in a region adjacent said combustion chamber so as to promote further combustion of the exhaust gases, said secondary air inlet means including air distributor means arranged in said exhaust conduit, the air distributor means comprising a central pipe connected to outwardly directed branch pipes provided with air outlets, the branch pipes having lateral air openings on corresponding sides thereof so as to emit a generally horizontal sheet of secondary air, said exhaust conduit further including a wall defining secondary air inlets over at least part of the extent of the air distributor means, the air outlets being so arranged and dimensioned as to promote with the upwardly directed air introduced through the exhaust conduit wall a helical flow of the ascending exhaust gases, thereby lengthening the secondary combustion path and ensuring a complete mix of gases and air.

8. The combustion apparatus of claim 7 wherein the lowermost branch pipes have upwardly directed outlet openings in order to encourage upward flow of exhaust gases in the vicinity of said primary combustion chamber and to encourage a cross mixing of gases.

9. The combustion apparatus of claim 7 wherein the air distributor means is connected to a source of compressed air.

10. The combustion apparatus of claim in claim 9 wherein the lowermost branch pipes have upwardly directed outlet openings in order to encourage upward flow of exhaust gases in the vicinity of said primary combustion chamber and to encourage a cross mixing of gases.

11. The combustion apparatus of claim 7 and which further includes a casing enshrouding said exhaust conduit in the region of the secondary combustion zone, said casing having a lower opening through which air is introduced to flow upwardly over the outside surface of said exhaust conduit.

12. The combustion apparatus of claim 7 and further including exhaust gas recycling means comprising a return pipe for returning part of the gas flow downstream of said secondary air inlet means to said primary combustion chamber.

13. A combustion apparatus comprising:

a combustion chamber for effecting primary combustion of combustible material charged thereinto;

an exhaust conduit for exhaust gases emitted by the primary combustion;

primary air inlet means for directing primary air into said combustion chamber;

secondary air inlet means for directing secondary air into said exhaust conduit at least in a region adjacent said combustion chamber so as to promote further combustion of the exhaust gases, said secondary air inlet means including air distributor means arranged in said exhaust conduit, said exhaust conduit including a wall defining secondary air inlets over at least part of the extent of the air distributor means; and exhaust gas recycling means comprising a return pipe for returning part of the gas flow downstream of said secondary air inlet means to said primary combustion chamber.

14. The combustion apparatus of claim 13 and further including means for introducing additional air into the returning gas flow.

* * * * *